US005427278A

United States Patent [19]

Gardner, III

[11] Patent Number: 5,427,278

[45] Date of Patent: Jun. 27, 1995

[54] HIGHLIGHTING-INK REMOVER APPLICATOR

[76] Inventor: William G. Gardner, III, 4608 W. Bluefield Ave., Glendale, Ariz. 85308

[21] Appl. No.: 267,479

[22] Filed: Jun. 28, 1994

Related U.S. Application Data

[63] Continuation-in-part of Ser. No. 243,051, Sep. 9, 1988, Pat. No. 5,324,131.

[51] Int. Cl.[6] ..... B43K 5/00

[52] U.S. Cl. ..... 222/129; 106/19 A; 106/22 B; 134/95.3; 252/183.13; 222/394; 401/34

[58] Field of Search ..... 252/183.13, 182.12; 401/34; 106/19 A, 20 R, 21 A, 22 R, 22 B; 134/95.3, 103.2; 222/129, 321, 394, 402.1

[56] References Cited

U.S. PATENT DOCUMENTS

| | | | |
|---|---|---|---|
| 659,109 | 10/1900 | Smith | 401/219 |
| 3,859,044 | 1/1975 | Blomfield | 8/142 |
| 3,941,488 | 3/1976 | Maxwell | 401/17 |
| 3,953,353 | 4/1976 | Barrett, Jr. et al. | 252/174 |
| 4,227,930 | 10/1980 | Lin | 106/19 A |
| 4,252,845 | 2/1981 | Griffiths et al. | 106/21 A |
| 4,681,471 | 7/1987 | Hayduchok et al. | 401/34 |
| 4,845,790 | 7/1989 | Brasington | 8/150 |
| 4,979,840 | 12/1990 | Madaus et al. | 401/202 |
| 5,006,171 | 4/1991 | Mecke et al. | 222/22 B X |
| 5,290,470 | 3/1994 | Dutcher | 252/102 |
| 5,324,131 | 6/1994 | Gardner, III | 401/199 |

*Primary Examiner*—Kevin P. Shaver

*Attorney, Agent, or Firm*—Antonio R. Durando; Harry M. Weiss

[57] ABSTRACT

An applicator for eradicating or removing transparent or translucent emphasizing inks, particularly from a paper surface, wherein the emphasizing ink has been used over permanent ink or a printed surface to emphasize such surface or a writing thereon. The applicator comprises a container, a liquid bleaching or oxidizing agent in the container for the emphasizing ink and means on one end of the container, such as a felt tip, roller, pressurized spray nozzle or hand pump, to apply a thin film of the ink removing agent to the emphasizing ink and to effect the eradication or removal thereof without substantially affecting the underlying ink or printed material which has been emphasized. In another embodiment of the invention, a dispenser of a neutralizing agent is also provided to abate the effects of excess bleaching or neutralizing agents on the surface being treated.

18 Claims, 2 Drawing Sheets

HIGHLIGHTING-INK REMOVER APPLICATOR

CROSS-REFERENCE TO RELATED APPLICATION

This application is a continuation-in-part of U.S. Ser. No. 07/243,051, filed Sep. 9, 1988, entitled "EMPHASIZING INK REMOVING APPLICATOR AND INK REMOVING METHOD," now U.S. Pat. No. 5,324,131, hereby incorporated by reference.

BACKGROUND OF THE INVENTION

1. Field of the Invention

This invention is related in general to erasing devices and, in particular, to applicators for removing highlighting inks and colorings from a substrate surface containing written or printed material.

2. Description of the Prior Art

Many brand names and varieties of markers exist for the purpose of emphasizing printed or written material and of highlighting particular areas of a paper surface. For example, one such commercial type of marker is produced by Carter's Ink Company of Cambridge, Mass., and is known by the trademark "HILITER ®."

Typically, these emphasizing markers use pastel or fluorescent shades of transparent or translucent inks or dyes which are water-based and non-pigmented. Such highlighting inks and dyes are generally applied by rubbing a liquid-saturated, felt-tipped applicator across or around the paper surface that is to be highlighted and generally over a permanent, pigmented type of ink marking that is being emphasized. The paper surfaces typically are photocopies, books, drawings, newsprint, documents or other similar papers having rather permanent, pigmented type of ink or print thereon.

Highlighting is so easy to apply that it is often overused; mistakes are easy to make and most unfortunately many of the highlighted-surface colors are reproduced as gray-shaded areas on photocopies. It is therefore highly desirable to provide a means for erasing, eradicating or otherwise removing these highlighting inks or dyes from paper or other substrate surfaces with little or no effect on the underlying printed, written or photocopied text and without material damage to the paper or other surface.

A few products have been introduced in the market to fulfill this need. For example, U.S. Pat. No. 3,941,488 to Maxwell (1976) describes a marker/eraser combination designed to provide the ability to erase the markings produced by the marker by utilizing specific chemical reagents. The idea of the patent is to combine each marker ink with a corresponding erasing reagent capable of removing the ink without affecting the underlying text and substrate. One of the patent's stated objectives is to avoid using bleaches, which not only bleach many inks but also any color present in the writing paper.

A comparable approach is followed by Hayduchok et al. in U.S. Pat. No. 4,681,471 (1987), where a kit is disclosed comprising a combination of markers and an erasing unit where the chemical constituents of the dyes are chosen to be compatible for eradication by a specific reducing agent. The patent describes these chemicals in detail and is limited to combinations thereof.

Similarly, the Carter's Ink Company has also marketed an ink eraser (RYTOFF ®) based on bleaching ingredients to remove pen writings. Because of the method of application of the bleaching agent, blotting of excess reagent is necessary to avoid damage to the substrate. Experiments have shown that this product does not generally remove inks other than water-based non-pigmented inks (the instructions specifically exclude ball-pen inks). In addition, this product is intended for use with writings produced by pens, but not to erase markings produced by their HILITER ® or other markers.

Therefore, there still exists a need for a generic eraser suitable for use with a wide class of markers, rather than coupled to markers having specific reagent characteristics. In particular, inasmuch as most markers available today are based on water-based, non-pigmented dyes, it would be very desirable to have a product capable of erasing markings produced by any of them.

SUMMARY OF THE INVENTION

The main purpose of this invention is a highlighting-ink remover applicator that is suitable for use with conventional markers available today. Accordingly, as described in my application Ser. No. 07/243,051, this invention relates to a highlighting-ink remover applicator, a kit containing the applicator and a method of using the applicator and kit so as to erase, eradicate or remove certain types of inks and dyes from paper surfaces without substantially affecting the underlying printing, writing or the underlying substrate surface.

I discovered that transparent or translucent, pastel or fluorescent, water-based, non-pigmented inks or dyes (which are the basic constituents of all markers—such as HILITER ®—commonly used to emphasize or highlight areas on paper surfaces, normally called emphasizing inks) can be erased, eradicated or essentially removed by the application of a thin film of a water-based, liquid bleaching agent. I also discovered that these bleaching agents, as well as other oxidizing chemicals that have a similar effect, can erase marker colorings without substantially affecting other types of more permanent inks (such as those used in thermosetting, cured resin, pigment-type, india ink, and non-aqueous inks) which are not used for highlighting, but rather are normally used for textbooks, printing or photocopying. These bleaching and oxidizing agents also do not produce any significant effect on most ballpoint-pen inks, although they can lighten or almost remove some of the more exotic colors and some water-based ballpoint-pen inks (as shown by the Carter product). It has further been discovered that the application of a thin film of bleaching agent, unless used in excess, does not require blotting and does not significantly affect most paper surfaces (some papers pucker slightly).

Thus, these discoveries used together permit the selective removal of water-based non-pigmented highlighting inks from more permanent inks while inflicting little or no damage to the underlying paper substrate. In fact, the removal, erasure or eradication of an emphasizing ink restores the text, document, etc. to nearly its original condition, thus allowing photocopying or re-highlighting as desired and appropriate.

The application of a liquid bleach or oxidizing agent to the highlighting ink being removed may be accomplished by a number of techniques, methods and containers for the active agent. The agent may be applied successfully to a variety of surfaces such as plastic, paper, and some synthetic fabrics or the like (but I found that it should not be used on silk, rayon or wool); however, it is particularly useful and effective when the underlying surface is paper. Aqueous bleaching agents might produce a slight puckering in some papers but, upon drying, the papers are normally not further affected by the bleaching solution. If, necessary, as disclosed in my copending application and further detailed below, a neutralizing agent may be used to minimize any such damage.

Typically, the erasing agent is applied in a thin film by one of several ways. First, by an open-cell applicator, such as a cotton or felt tip, or an open sponge material, saturated with the liquid bleaching solution and rubbed directly against the highlighted surface. This means of applying the liquid erasing agent would include fibrous, open-celled materials that are not dissolved or affected by the bleaching or oxidizing solution, such as resin-impregnated felt materials, as well as open-celled polyvinyl chloride or urethane-type foams, all of which are flexible and soft, and permit the application of a thin film. In this embodiment, the liquid bleaching or oxidizing agent is applied with a device comprising a container for the solution wherein the felt tip or open-celled foam applicator at one end of the container is saturated by direct contact with the liquid agent in the container and is applied as desired in a thin film by lightly rubbing the felt- or foam-saturated tip along the surface where the ink is to be removed.

In another embodiment, a thin film can be applied by means of a roller made of a ceramic, nylon or other synthetic material that is not affected by the bleaching or oxidizing solution. The roller should be at one end of the container in such a way that approximately one-half of the roller is in contact with the bleach or oxidizing agent and the other half is accessible so as to be rolled across the surface being bleached. This alternative means of application may be more gentle with the paper surface than the open-celled tip would be because its use does not result in rubbing the surface.

In yet another embodiment first disclosed herein, the bleaching and oxidizing agents of the invention are applied to the inks being erased in aerosol form. Therefore, the erasing agents are stored in applicators consisting of an aerosol can. Finally, the agents may similarly be used in a hand-pump sprayer.

In all configurations for the applicator of the invention that utilize bleach as the active reagent, but particularly for the aerosol and hand-pump embodiments that deliver droplets rather than thin film, it is optionally desired to either blot out excess liquid or to employ a method of neutralizing or otherwise rendering ineffective excess bleaching agent after such agent has accomplished its bleaching function. This is an optional feature of the invention, and a variety of bleach-killing agents may be employed as desired; for example, aqueous solutions of thiosulfate, such as sodium thiosulfate. Note that this liquid-bleach neutralizing agent is not particularly needed on most paper materials, and it is particularly not needed for non-bleach oxidizing agents, but could be useful when the underlying material may be affected by excess liquid bleaching agent. Moreover, neutralization may be desirable when one wishes to change the color a highlighted area by erasing a first application and reapplying highlighting ink of a different kind. In some cases the neutralizing agent may prevent unwanted effects to the underlying material if the liquid bleaching agent is overused or contains too strong a concentration for that particular type of underlying ink or surface. For example, selective removal of highlighting from an unusual color of ballpoint pen ink on an exotic writing surface may require neutralizing the bleach as soon as it has erased the highlighting, so as not to affect the underlying material.

The invention also comprises a kit combining an ink emphasizing marker and an unmarker, wherein conventional, commercially-available water-based non-pigmented felt-tipped markers containing highlighting or emphasizing ink material in various colors, as required, are combined with an ink eradication unmarker particularly designed to eradicate that ink material (which unmarker would comprise a liquid bleach or an oxidizing agent in a container and optionally a bleach killing or neutralizing agent in a separate container). In this manner, the unmarker applicator may be particularly adapted in concentration and selection of the particular bleach or oxidizing agent to be rapidly and especially effective in removing, erasing or eradicating the highlighting material in the particular kit.

A wide variety of liquid bleaches and oxidizing agents and of concentrations thereof may be employed in the practice of the invention for erasing the water-based non-pigmented transparent inks used to emphasize printing or writing. I discovered that halogen-containing liquid bleaching solutions are particularly effective. Alkali and alkaline-earth salt solutions formed with hypochlorites (bleaches), triazine chlorine, and triazine-type derivatives are desirable. In particular, I found that sodium lithium and calcium hypochlorite solutions; chlorine triazinetrione solutions, such as sodium or potassium dichloro-s-triazinetrione and trichloro-s-triazinetrione solutions; sodium, potassium and ammonium persulfate and potassium peroxymonosulfate solutions; and solutions of 1-bromo-3-chloro-5-dimethylhydantoin either alone or in combination with 1,3-dichloro-5,5-dimethylhydantoin and 1,3-dichloro-5-ethyl-5-methylhydantoin are particularly desirable for removing highlighting ink from paper sheets without affecting the underlying printed material. The type of bleaching agent and the concentration employed may vary as desired against any particular transparent ink to be removed and particularly in the selection of kit components for which the bleach or oxidizing agent and the bleach neutralizing agent should be matched to the particular translucent ink employed in the kit.

The halogen bleaching agents and the oxidizing agents work well on a wide variety of highlighting inks, flair-type pens, and some felt-tipped markers, so long as consisting of water-based non-pigmented dyes. For example, I found that translucent highlighter inks were removed almost completely for every type and color of highlighter ink presently and generally widely commercially available and that such agents worked, but not quite as well, on most of the colors of the flair-type, fine print, fiber-tipped marking pens that may be used for emphasizing. I found that some of the flair-type inks required several applications of a bleach or oxidizing agent for removal and, in a small number of cases, some inks left a lightly visible mark. These bleaches and oxidizing agents were found to also remove some computer print, blue lines on some pad paper, and color from a variety of colored papers, so care should be employed in using a colored paper substrate.

The invention is described for the purpose of illustration only in connection with certain embodiments, However, various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced and it is recognized that those skilled in the art may make various changes, additions, modifications and improvements to the embodiments so described that fall within the spirit and scope of the invention.

DESCRIPTION OF THE PREFERRED EMBODIMENTS

The heart of this invention is in the recognition that common bleach constituents and other oxidizing agents can be used to successfully remove water-based, non-pigmented highlighter inks overlying material printed or written with pigmented or other non-water-based inks on a common substrate. While this property was recognized for sodium hyplochlorite (bleach) by The Carter's Ink Company to remove pen writing, prior to this invention no one realized that the contituents of bleach could be used successfully to remove highlighter markings as well. In discussing such use, the Maxwell patent suggests that it would not be possible without causing a deterioration of the underlying writing and substrate material.

This disclosure teaches the use of bleach by means of applicators that eliminate the need for blotting excess fluid and, when necessary, it teaches the combined use of a bleach with a neutralizing agent to stop the bleaching action and avoid damage to the substrate material and allow reapplication of highlighting ink. Finally, this invention discloses several other oxidizing agents that are suitable for removing highlighter inks without affecting underlying print or writing or altering the underlying substrate.

Figure 1:
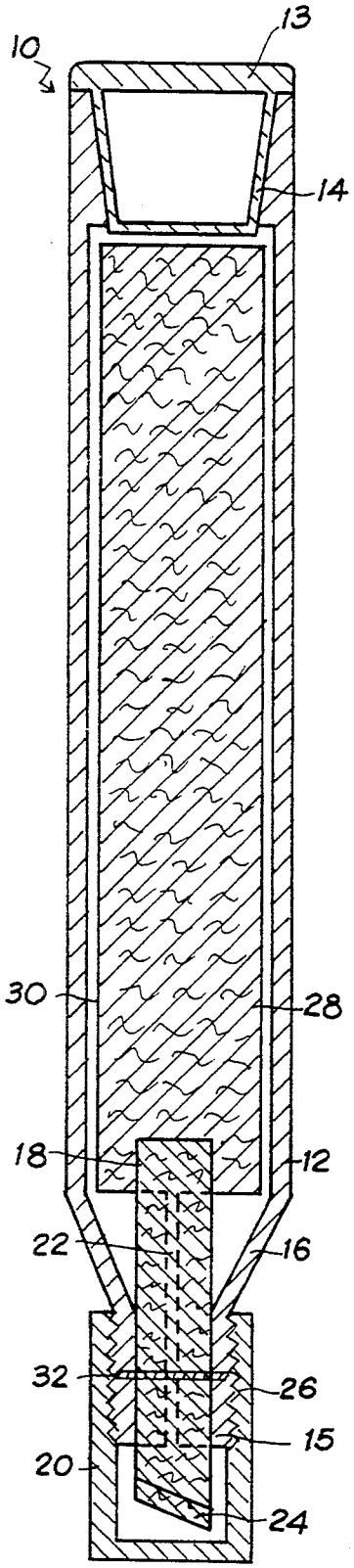
FIG. 1 is an illustrative, schematic, cross sectional view of a felt-tip highlighting-ink removing applicator useful in the invention.

FIG. 1 is an illustrative, schematic, cross-sectional view of a highlighting-ink remover applicator 10 that comprises an elongated container 12 having two open ends 14 and 15. A push-in filler cap 13 is fit at the first end 14 to provide an airtight closure, and a tapered section 16 connects the main body of the container 12 to a second, threaded end 15, which is also covered by a matingly threaded screw-cap 20. Airtight threads 26 between the end 15 and the cap 20 ensure complete closure of the container 12 when the cap is on.

The tapered section 16 contains a resin-impregnated round wick 18 that is tightly fitted within the tapered section 16 so as to prevent any loss of fluid from the interior of the container 12 other than through passage through the wick. The fluid contents of the applicator 10 may consist of a bleach solution or an oxidizing agent solution for application over highlighting ink, whichever is employed for a particular application. A batting-type material 28 is placed within the container 12 to hold a highlighting-ink remover solution 30, such as a sodium hypochlorite solution, wherein the batting material (such as cotton, for example) is formed in a plastic sheath 30 one to two thousands of an inch thick. The resin-impregnated round wick 18 has a felt, chisel-type, flat tip 24 for the application of a thin film of the solution 30 from the container 12 onto the highlighting ink to be erased from a paper sheet. The cotton batting 28 is saturated with the liquid solution 30 and is in fluid communication with the resin-impregnated round wick 18, so that the chisel tip 24 of the wick is at all times maintained saturated with highlighting-ink remover solution 30 by capillary and gravity action. The end 15 of the container 12 contains a slight air channel 22 between the wick and the side of the container to permit the passage of air to facilitate fluid flow to the wick during use. The resin-impregnated round wick 18 which is kept in position by a transverse pin 32, such as nylon pin, extending through the wick and attached to the inner sides of the end 15 of the container 12.

I found that the bleach and oxidizing agents listed in Table 1 below, applied in thin films over highlighting inks in concentrations at least as great as reported herein (up to saturation, at room temperature), are very effective removers of such inks without causing noticeable effects on underlying print or writing, or damage to the underlying substrate.

TABLE 1

| Active Ingredient | Minimum Percent by Weight in Water Solution |
|---|---|
| sodium hypochlorite | 0.30 |
| lithium hypochlorite | 0.30 |
| calcium hypochlorite | 0.30 |
| sodium persulfate | 40.00 |
| potassium monopersulfate | 20.00 |
| ammonium persulfate | 20.00 |
| potassium peroxymonosulfate | 1.30 |
| sodium dichloro-s-triazitrione | 0.30 |
| trichloro-s-triazitrione | 0.16 |
| 1-bromo-3-chloro-5-dimethylhydantoin | 2.80 |
| a mixture of | 0.50 |
| 1-bromo-3-chloro-5-dimethylhydantoin (60%) | |
| 1,3-dichloro-5,5-dimethylhydantoin (30%) | |
| 1,3-dichloro-5-ethyl-5-methylhydantoin (10%) | |

All of these ingredients were tested at concentrations as high as saturation in water solutions with no significant difference in the observed results. As expected, higher concentrations tend to produce faster removal of highlighting inks, but all concentrations between the given lower limits and saturation were found to be useful to practice the invention. In particular, 5.25% and 12.5% by weight (at room temperature) solutions of sodium hypochlorite (corresponding to the product concentrations distributed commercially), and saturated solutions of trichloro-s-triazinetrione and of calcium hypochlorite were particularly effective in ink removing applicators of the type described.

On the other hand, not all oxidizing agents are suitable for this invention. For example, I found that a 3% solution of hydrogen peroxide, a 6% solution of hydrogen peroxide, and a 6% solution of hydrogen peroxide with ammonia added (hair bleaching solution) are not effective. In addition, tests with various solutions of nitrates of yttrium, strontium, sodium, barium, potassium, cerium, silver, cobalt, ceric ammonium, and lanthanum; as well as tests with potassium perchlorate, dichromate and permanganate proved to be also unsatisfactory. Thus, it appears that bleach and chlorine-type oxidizing agents work particularly well against transparent, water-based, non-pigmented highlighting-ink compositions to be removed, while peroxide-type oxidizing-agent solutions are not similarly effective.

Preferably, because of commercial availability, each disclosed substance is used in the percentages listed in Table 2.

TABLE 2

| Active Ingredient | Minimum Percent by Weight in Water Solution |
|---|---|
| sodium hypochlorite | 5.25 |
| lithium hypochlorite | 5.25 |
| calcium hypochlorite | 5.25 |
| sodium persulfate | 45.00 |
| potassium monopersulfate | 25.00 |
| ammonium persulfate | 25.00 |
| potassium peroxymonosulfate | 5.00 |
| sodium dichloro-s-triazitrione | 5.00 |
| trichloro-s-triazitrione | 5.00 |
| 1-bromo,3-chloro,5-dimethylhydantoin | 3.00 |
| a mixture of 1-bromo-3-chloro-5-dimethylhydantoin (60%) 1,3-dichloro-5,5-dimethylhydantoin (30%) 1,3-dichloro-5-ethyl-5-methylhydantoin (10%) | 2.00 |

As those skilled in the art would recognize, I would expect that any alkali-metal or alkaline-earth-metal salts of the oxidizing radicals disclosed above, and mixtures thereof, as well as of equivalent radicals of other halogens, would provide equivalent highlighting-ink removing properties. For instance, a potassium hypochlorite or sodium hypobromite water solution in a concentration above 0.3 percent by weight (at room temperature) would most likely perform in a fashion equivalent to the corresponding sodium hypochlorite solution. In addition, I would similarly expect halogen compounds of hydantoin and similar substances such as 1,3-dibromo-5-isopropyl-5-methylhydantoin; 1,3-dibromo-5,5-ethyl-5-methylhydantoin; 1,3-dibromo-5,5-dimethylhydantoin; 1,3-dichloro-5,5-dimethylhydantoin; 1,3-dibromo-5-ethyl-5-methylhydantoin; and 1,3-dichloro-5-ethyl-5-methylhydantoin, either alone or in combination, to be effective highlighting-ink removers.

Figure 2:
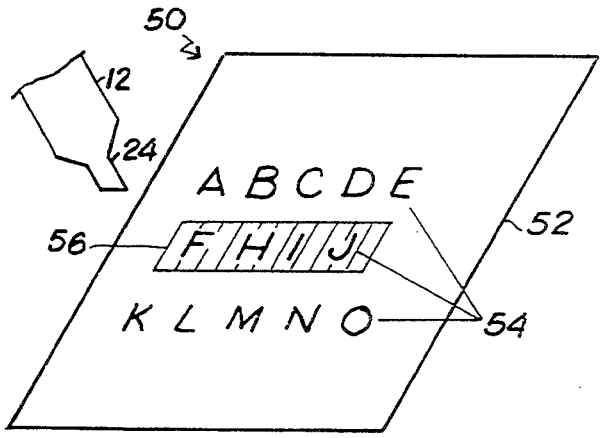
FIG. 2 is an illustrative, schematic view of a printed sheet material containing a section highlighted with translucent ink.
Figure 3:
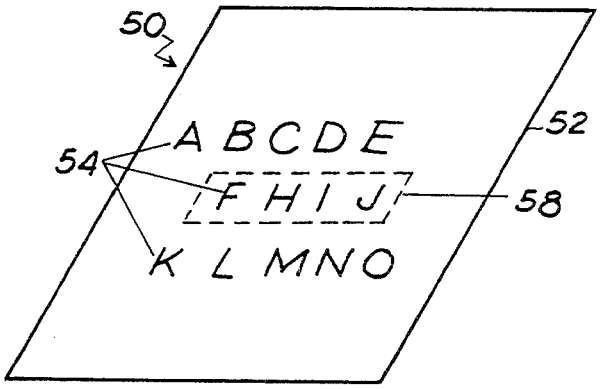
FIG. 3 illustrates the printed material of FIG. 2 after removal of the highlighter ink from the highlighted section.

FIGS. 2 and 3 represent a schematic illustration of the use the applicator 10 of FIG. 1 in connection with the removal of a transparent, water-based, non-pigmented highlighting ink from a printed page. The applicator is illustrated as the container 12 with a chisel tip 24 for dispensing a thin film of liquid bleach or oxidizing agent over a document system 50 comprising a paper sheet 52 on which letters of the alphabet 54 are printed with certain portions (F-H-I-J) shown as being highlighted by a transparent, water-based, non-pigmented ink 56 dried on the surface of the sheet 52. The felt tip 24 containing the liquid solution of highlighting-ink remover is then shown applied over the F-H-I-J portion of the dried translucent ink 56. The result is illustrated in FIG. 3, wherein it is shown that the translucent ink 56 has been removed without affecting the underlying printed words 54 or the paper sheet 52, the removal area 58 being blended into the paper area 52 so as to be substantially unnoticeable, and the underlying printed material 54 and the paper 52 being not visibly affected by the highlighting-ink remover solution.

Note that the applicator 10 of FIG. 1 may be filled either with a bleach or oxidizing solution, or with a bleach neutralizing solution for application after the highlighting ink is removed in order to neutralize excess remover. It is expected that any reducing agent suitable for safe use in applicator form and capable of reacting with the particular bleach or oxidizing agent used as highlighting-ink remover would be acceptable as a neutralizing agent. Aqueous solutions of a thiosulfate alkali salt, such as sodium thiosulfate, in concentrations varying from approximately 0.1 weight percent at room temperature to saturation, are found to be particularly effective. An eradicator applicator and a neutralizing applicator may each be employed alone or as a kit, and either may be employed in combination with highlighting-ink markers. Also, as is generally the case for products based on these active constituents, the bleach, oxidizing agents and neutralizing agents used in the applicators of the invention may not necessarily be in a pure aqueous solution, but may be mixed with an alcohol or another type of volatile solvent. Typically, the commercially-available bleach and oxidizing agents of the type disclosed contain solvents or diluents or other additives, such as propylene, ethylene glycol or alcohol, isopropynol, or similar materials, as well as additives such as stabilizers and other materials that may be employed to enhance the removal of the highlighting ink.

Therefore, the invention provides a means for employing one or more applicators containing an ink bleaching or oxidizing solution and optionally a neutralizing solution, and it provides a method of erasing or eradicating transparent emphasizing ink from a surface that remains unaffected by the removing solution.

Figure 4:
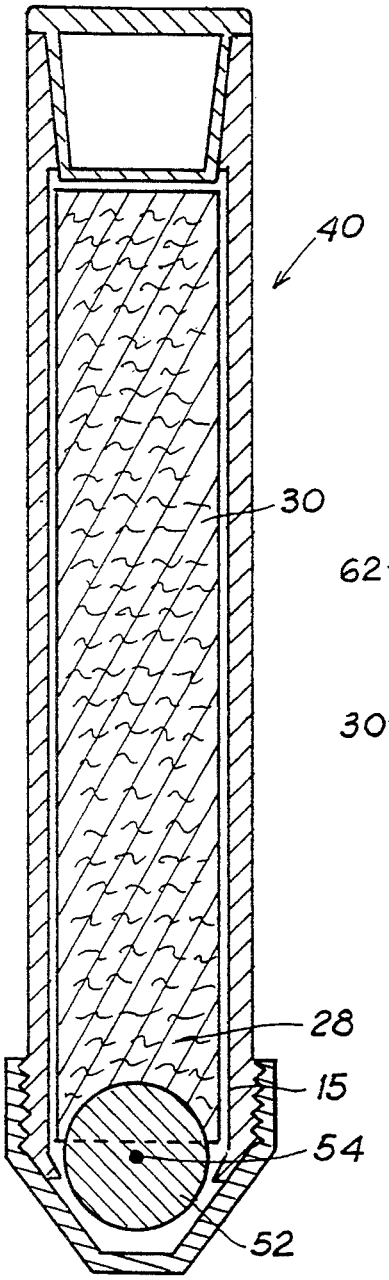
FIG. 4 illustrates an applicator according to the invention having a roller-tip fluid delivery mechanism.

FIG. 4 illustrates a roller-tip applicator 40 that differs from the applicator 10 of FIG. 1 in the way the fluid solution 30 is dispensed over a substrate. A roller 52 is rotatably mounted on a transverse axle 54 in the capped end 15 of the container, such that a portion of the roller protrudes outward for free contact with the highlighting-ink surface being treated. The roller 52 is partially immersed in the batting material 28 so that it can be kept impregnated with the solution 30 as it is being dispensed over the treated area.

Figure 5:
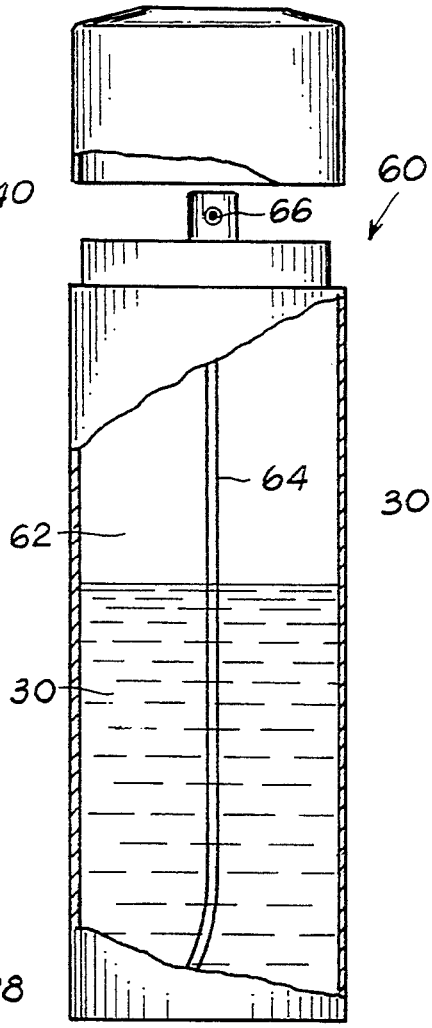
FIG. 5 illustrates an applicator according to the invention having a pressurized aerosol spray-tip fluid delivery mechanism.
Figure 6:
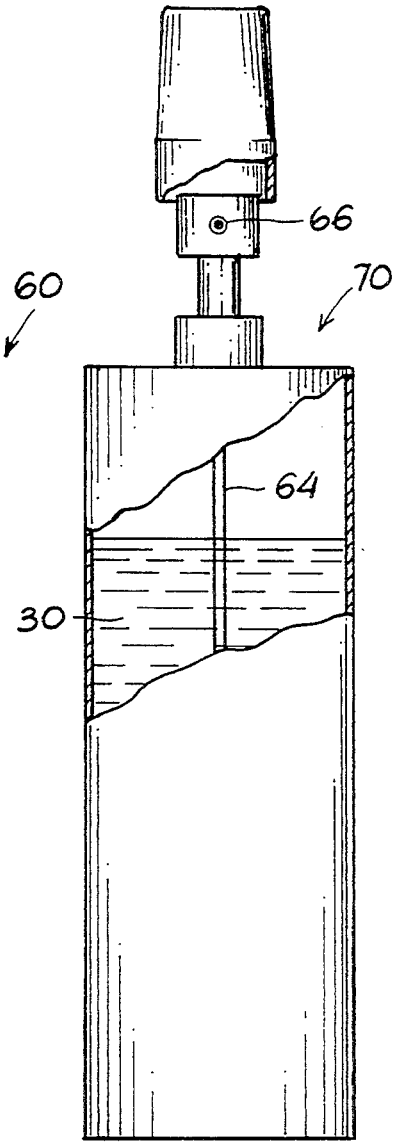
FIG. 6 illustrates an applicator according to the invention having a hand-pump spray-tip fluid delivery mechanism.

In another form of applicator shown in the partially cut-out view of FIG. 5, the solution 30 is contained in a conventional pressurized aerosol can 60, from which the solution may be sprayed as needed to remove highlighting ink from a surface. A pressurized gas in the upper portion 62 of the can provides the force necessary to cause the liquid solution to flow through a tube 64 and out of a conventional spray nozzle 66. Similarly, the applicator of the invention may consist of a standard hand-pump canister 70, as used for hair sprays and perfumes. Such an embodiment is illustrated in FIG. 6.

In either case, the solution 30 of the invention, whether it be bleach, an oxidizing agent or a neutralizing substance, should be dispensed in as fine a mist as possible to avoid formation of droplets over the surface being treated. If the accumulation of excess spray results in the presence of such liquid drops on the surface, blotting would be recommended to avoid impregnation and possible warping of the surface, specially in the case of a paper surface.

Various changes in the details, steps and materials that have been described may be made by those skilled in the art within the principles and scope of the invention herein illustrated and defined in the appended claims. For example, other types of fluid storage and application, such a by brushing, may be employed. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and methods.

I claim:

1. Apparatus for removing water-based non-pigmented highlighting ink deposited over highlighted areas of a surface, comprising:

(a) a container adapted to hold a liquid in airtight enclosure;

(b) a liquid highlighting-ink removing agent held in said container, said agent being a solution of a reagent selected from the group consisting of hypochlorites and hypobromites of alkali metals, hypochlorites and hypobromites of alkaline earth metals, persulfates of alkali metals, peroxymonosulfates of alkali metals, mono- and dichloro-s-triazitriones of alkali metals, trichloro-s-triazitriones, bromo and chloro substitutes of methyl- and ethylhydantoin, and mixtures thereof; and (c) applicator means for applying a thin film of said liquid highlighting-ink removing agent onto said surface, said applicator means being incorporated in said container and in fluid communication with said liquid held in the container.

2. The apparatus of claim 1, wherein said liquid highlighting-ink removing agent is a solution of a reagent selected from the group consisting of the following ingredients or mixtures thereof in amounts varying between the concentrations reported below and saturation:

| Active Ingredient | Minimum Percent by Weight in Water Solution |
|---|---|
| sodium hypochlorite | 0.30 |
| lithium hypochlorite | 0.30 |
| calcium hypochlorite | 0.30 |
| sodium persulfate | 40.00 |
| potassium monopersulfate | 20.00 |
| ammonium persulfate | 20.00 |
| potassium peroxymonosulfate | 1.30 |
| sodium dichloro-s-triazitrione | 0.30 |
| trichloro-s-triazitrione | 0.16 |
| 1-bromo-3-chloro-5-dimethylhydantoin | 2.80 |
| a mixture of | 0.50 |
| 1-bromo-3-chloro-5-dimethylhydantoin (60%) | |
| 1,3-dichloro-5,5-dimethylhydantoin (30%) | |
| 1,3-dichloro-5-ethyl-5-methylhydantoin (10%) | |

3. The apparatus of claim 1, wherein said liquid highlighting-ink removing agent is a solution of a reagent selected from the group consisting of the following ingredients or mixtures thereof in amounts corresponding to the concentrations reported below:

| Active Ingredient | Minimum Percent by Weight in Water Solution |
|---|---|
| sodium hypochlorite | 5.25 |
| lithium hypochlorite | 5.25 |
| calcium hypochlorite | 5.25 |
| sodium persulfate | 45.00 |
| potassium monopersulfate | 25.00 |
| ammonium persulfate | 25.00 |
| potassium peroxymonosulfate | 5.00 |
| sodium dichloro-s-triazitrione | 5.00 |
| trichloro-s-triazitrione | 5.00 |
| 1-bromo-3-chloro-5-dimethylhydantoin | 3.00 |
| a mixture of | 2.00 |
| 1-bromo-3-chloro-5-dimethylhydantoin (60%) | |
| 1,3-dichloro-5,5-dimethylhydantoin (30%) | |
| 1,3-dichloro-5-ethyl-5-methylhydantoin (10%) | |

4. The apparatus of claim 1, wherein said applicator means consists of a wick in fluid communication with said liquid highlighting-ink removing agent held in said container, said wick including a tip adapted to supply a thin film of said agent to said highlighted areas of a surface upon sliding contact therewith.

5. The apparatus of claim 1, wherein said applicator means consists of a roller tip in fluid communication with said liquid highlighting-ink removing agent held in said container, said roller tip being adapted to supply a thin film of said agent to said highlighted areas of a surface upon rolling contact therewith.

6. The apparatus of claim 1, wherein said container is pressurized with a gas and said applicator means consists of an aerosol spray tip in fluid communication with said liquid highlighting-ink removing agent held in the container, said spray tip being adapted to supply a thin mist of said agent to said highlighted areas of a surface upon controlled release of said gas.

7. The apparatus of claim 1, wherein said said applicator means consists of a hand-pump spray tip in fluid communication with said liquid highlighting-ink removing agent held in the container, said spray tip being adapted to supply a thin mist of said agent to said highlighted areas of a surface upon stroking of said hand-pump spray tip.

8. Apparatus for removing water-based non-pigmented highlighting ink deposited over highlighted areas of a surface, comprising:

(a) a first container adapted to hold a first liquid in airtight enclosure;

(b) a liquid highlighting-ink removing agent held in said first container, said liquid highlighting-ink removing agent being a solution of a reagent selected from the group consisting of hypochlorites of alkali metals, hypochlorites of alkaline earth metals, and mixtures thereof;

(c) first applicator means for applying a thin film of said liquid highlighting-ink removing agent onto said surface, said first applicator means being incorporated in said first container and in fluid communication with said liquid highlighting-ink removing agent held in the first container;

(d) a second container adapted to hold a second liquid in airtight enclosure;

(e) a liquid neutralizing agent held in said second container, said liquid neutralizing agent being a solution of a reducing compound capable of neutralizing said liquid highlighting-ink removing agent; and (f) second applicator means for applying a thin film of said liquid neutralizing agent onto said surface, said second applicator means being incorporated in said second container and in fluid communication with said liquid neutralizing agent held in the second container.

9. The apparatus of claim 8, wherein said liquid highlighting-ink removing agent is a solution of a reagent selected from the group consisting of the following ingredients or mixtures thereof in amounts varying between the concentrations reported below and saturation:

| Active Ingredient | Minimum Percent by Weight in Water Solution |
|---|---|
| sodium hypochlorite | 0.30 |
| lithium hypochlorite | 0.30 |
| calcium hypochlorite | 0.30; |

and wherein said liquid neutralizing agent consists of an aqueous solution of a thiosulfate salt in a concentration between about 0.1 percent by weight and saturation at room temperature.

10. The apparatus of claim 8, wherein said liquid highlighting-ink removing agent is a solution of a reagent selected from the group consisting of the following ingredients or mixtures thereof in amounts corresponding to the concentrations reported below:

| Active Ingredient | Minimum Percent by Weight in Water Solution |
|---|---|
| sodium hypochlorite | 5.25 |
| lithium hypochlorite | 5.25 |
| calcium hypochlorite | 5.25; |

and wherein said liquid neutralizing agent consists of an aqueous solution of sodium thiosulfate salt in a concentration between about 0.1 percent by weight and saturation at room temperature.

11. The apparatus of claim 8, wherein said first applicator means consists of a first wick in fluid communication with said liquid highlighting-ink removing agent held in said first container, said first wick including a tip adapted to supply a thin film of said liquid highlighting-ink removing agent to said highlighted areas of a surface upon sliding contact therewith.

12. The apparatus of claim 11, wherein said second applicator means consists of a second wick in fluid communication with said liquid neutralizing agent held in said second container, said second wick including a tip adapted to supply a thin film of said liquid neutralizing agent to said highlighted areas of a surface upon sliding contact therewith.

13. The apparatus of claim 8, wherein said first applicator means consists of a first roller tip in fluid communication with said liquid highlighting-ink removing agent held in said first container, said first roller tip being adapted to supply a thin film of said liquid highlighting-ink removing agent to said highlighted areas of a surface upon rolling contact therewith.

14. The apparatus of claim 13, wherein said second applicator means consists of a second roller tip in fluid communication with said liquid neutralizing agent held in said second container, said second roller tip being adapted to supply a thin film of said liquid neutralizing agent to said highlighted areas of a surface upon rilling contact therewith.

15. The apparatus of claim 8, wherein said first container is pressurized with a first gas and said first applicator means consists of a first aerosol spray tip in fluid communication with said liquid highlighting-ink removing agent held in the first container, said first aerosol spray tip being adapted to supply a thin mist of said liquid highlighting-ink removing agent to said highlighted areas of a surface upon controlled release of said first gas.

16. The apparatus of claim 15, wherein said second container is pressurized with a second gas and said second applicator means consists of a second aerosol spray tip in fluid communication with said liquid neutralizing agent held in the second container, said second aerosol spray tip being adapted to supply a thin mist of said liquid neutralizing agent to said highlighted areas of a surface upon controlled release of said second gas.

17. The apparatus of claim 8, wherein said first applicator means consists of a first hand-pump spray tip in fluid communication with said liquid highlighting-ink removing agent held in the first container, said first hand-pump spray tip being adapted to supply a thin mist of said liquid highlighting-ink removing agent to said highlighted areas of a surface upon stroking of said first hand-pump spray tip.

18. The apparatus of claim 17, wherein said second applicator means consists of a second hand-pump spray tip in fluid communication with said liquid neutralizing agent held in the second container, said second hand-pump spray tip being adapted to supply a thin mist of said liquid neutralizing agent to said highlighted areas of a surface upon stroking of said second hand-pump spray tip.

* * * * *